US011602663B2

(12) United States Patent
Endelman et al.

(10) Patent No.: US 11,602,663 B2
(45) Date of Patent: Mar. 14, 2023

(54) REFORMER EXERCISE APPARATUS FOOT BAR

(71) Applicant: Balanced Body, Inc., Sacramento, CA (US)

(72) Inventors: Ken Endelman, Sacramento, CA (US); Kit W. Spelman, Sacramento, CA (US); Albert R. Harrison, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 7 days.

(21) Appl. No.: 17/168,590

(22) Filed: Feb. 5, 2021

(65) Prior Publication Data

US 2022/0249902 A1 Aug. 11, 2022

(51) Int. Cl.
*A63B 21/00* (2006.01)
*A63B 21/04* (2006.01)

(52) U.S. Cl.
CPC ..... *A63B 21/4034* (2015.10); *A63B 21/0428* (2013.01); *A63B 21/4045* (2015.10); *A63B 2209/02* (2013.01)

(58) Field of Classification Search
CPC .. A63B 1/00–04; A63B 22/0076–0089; A63B 21/4033–4035; A63B 21/4034; A63B 21/0428; A63B 21/4045; A63B 2209/02; A63B 21/02; A63B 21/023; A63B 21/055; A63B 21/0552–0557; Y10T 403/10; Y10T 403/14–148; Y10T 403/32167; Y10T 403/32491; Y10T 403/46; Y10T 403/477–479; Y10T 403/55; Y10T 403/553; Y10T 403/556;
(Continued)

(56) References Cited

U.S. PATENT DOCUMENTS 6,371,895 B1 * 4/2002 Endelman ..... A63B 22/0087 482/96
8,721,511 B2 5/2014 Endelman et al.
(Continued)

FOREIGN PATENT DOCUMENTS

CN 211885186 U 11/2020
JP 09-057856 A 3/1997

OTHER PUBLICATIONS

Korean Intellectual Property Office; PCT Written Opinion of the International Searching Authority, issued in connection to application No. PCT/US2022/011942; dated May 4, 2022; 6 pages; Korea.
(Continued)

*Primary Examiner* — Joshua Lee
*Assistant Examiner* — Catrina A Letterman
(74) *Attorney, Agent, or Firm* — Greenberg Traurig, LLP

(57) ABSTRACT

A reformer exercise apparatus is disclosed that has a generally rectangular frame, a carriage movably supported on the frame, and a foot support member supported by the side rail portions of the frame. The foot support member has an inverted U shape carbon fiber tube having ends each fixed to a foot bar support member having a cylindrical base, a cylindrical post welded to the base, and a foot bar support arm welded to one end of the cylindrical base, for connection to a foot support assembly operable to selectively position the foot support member at various positions along the side rail portions of the frame.

20 Claims, 5 Drawing Sheets

(58) Field of Classification Search
CPC ..... Y10T 403/56; Y10T 403/70; Y10T 403/7003; Y10T 403/71
See application file for complete search history.

(56) References Cited

U.S. PATENT DOCUMENTS

| | | | | |
|---|---|---|---|---|
| 8,915,829 | B2 | 12/2014 | Endelman et al. | |
| 9,132,310 | B2 | 9/2015 | Endelman et al. | |
| 9,132,311 | B2 | 9/2015 | Masterson et al. | |
| 9,289,645 | B2 | 3/2016 | Masterson et al. | |
| 10,046,193 | B1 * | 8/2018 | Aronson | A63B 21/0407 |
| 10,843,031 | B1 * | 11/2020 | Anne | A63B 22/0087 |
| 2001/0056011 | A1 * | 12/2001 | Endelman | A63B 22/0087 482/121 |
| 2003/0195095 | A1 | 10/2003 | Endelman et al. | |
| 2005/0113227 | A1 * | 5/2005 | Endelman | A63B 22/0007 482/130 |
| 2006/0199712 | A1 * | 9/2006 | Barnard | A63B 22/203 482/142 |
| 2012/0295771 | A1 * | 11/2012 | LaGree | A63B 22/203 482/94 |
| 2013/0210593 | A1 * | 8/2013 | McBride | A63B 23/1218 482/142 |
| 2014/0100089 | A1 | 4/2014 | Kermath et al. | |
| 2014/0141948 | A1 * | 5/2014 | Aronson | A63B 22/0087 482/128 |
| 2014/0270925 | A1 * | 9/2014 | Lambertson, Jr. | B05C 17/0205 403/299 |
| 2014/0287892 | A1 * | 9/2014 | Varga | A63B 21/00065 482/135 |
| 2015/0065320 | A1 * | 3/2015 | Anderson | A63B 21/156 482/142 |
| 2015/0119213 | A1 * | 4/2015 | Savarino | A63B 22/0046 482/142 |
| 2018/0169464 | A1 * | 6/2018 | Janowski | A63B 22/0089 |
| 2020/0222741 | A1 * | 7/2020 | Aronson | A63B 21/154 |
| 2021/0023414 | A1 * | 1/2021 | LaFrance, III | A63B 21/002 |
| 2021/0244993 | A1 * | 8/2021 | Singer | A63B 22/0087 |

OTHER PUBLICATIONS

Korean Intellectual Property Office; PCT International Search Report, issued in connection to application No. PCT/US2022/011942; dated May 4, 2022; 4 pages; Korea.

* cited by examiner

REFORMER EXERCISE APPARATUS FOOT BAR

BACKGROUND OF THE DISCLOSURE

Field of the Disclosure

The present disclosure relates to a reformer exercise apparatus used in Pilates type exercise. In particular, it relates to a new lightweight foot bar that has a number of unique innovations.

State of the Art

Exercise machines utilized in the performance of physical exercises originated by Joseph Pilates typically are performed on a stationary apparatus called a reformer. An exemplary embodiment of such a reformer is disclosed in our U.S. Pat. No. 8,721,511 granted May 13, 2014 or one of its daughter patents, U.S. Pat. Nos. 8,915,829; 9,132,310; 9,132,311; and 9,289,645, the content of each of which is incorporated herein by reference in its entirety. One embodiment of this reformer is shown in FIG. 1. A separate perspective view of the conventional foot bar of this reformer is shown in FIG. 2.

Reformer apparatus 400 has a generally rectangular frame 402 with a head end 404 and a foot end 406. The ends 404 and 406 are spaced apart by a pair of parallel rail members 408. A carriage 410 is movably supported on the rail members 408 for movement back and forth between the ends 404 and 406 of the frame 402. The head end 404 of the frame 402 preferably supports a removable pair of spaced upright arm cord support risers 412. These risers 412 direct arm cords 414 from the carriage 410 to cord end loops 416 or grips for a user's hands for use in various exercises. When not in use, the end loops 416 may be conveniently positioned on the shoulder stops 418.

A padded steel foot bar 411 is positioned near the foot end 406 of the frame 402. This foot bar 411 is carried by the rail members 408 and can be slid along the rail members 408 between a number of selected positions on the rail members 408 in order to accommodate users of different heights and provide support for different exercise regimens. In order to move the foot bar 411 between selected positions, the foot bar 411 must be lifted and rotated to a precise predetermined angular position over the frame 402 and then lowered into a pair of notches in the foot bar support structure as described in detail in any one of the above identified patents. The foot bar 411 is a heavy, rigid U shaped steel bar that has an overmolded polymeric cover to provide a padded surface to the foot bar 411 so as to be comfortable when a user pushes against the foot bar 411 to move the carriage 410 back and forth along the rail members 408 during exercise.

A separate perspective view of the foot bar 411 is shown in FIG. 2. The foot bar 411 is a U shaped steel member has a central horizontal foot support portion 450 between two parallel leg portions 452 that extend at a right angle from the foot support portion 450. Each leg portion 452 terminates in a connection portion 454 that is fastened to a foot bar support arm of one of two foot bar support assemblies that carry the foot bar along the rail members 408. These foot bar support assemblies are described in detail in each of the above mentioned patents.

The steel foot bar 411 weighs about 18 lbs., and its entire weight must be lifted in order for a user to change position of the foot bar 411. Thus a user has to exert a substantial lifting force on the foot bar 411 in order to evenly lift the foot bar 411 out of its existing position and rotate it to a new desired angular position. For many users, such a lifting force is awkward and difficult to generate and the user may have to sit up on the carriage, rather than lying on it, or stand adjacent or over the foot end of the frame 402 and lift the foot bar 411 straight up to rearrange its position. What is needed therefore is a lightweight foot bar structure that is easy to manipulate while still retaining the rigidity and strength necessary to provide a solid support structure for the user's feet during use.

SUMMARY OF THE DISCLOSURE

A foot bar structure in accordance with the present disclosure addresses this need. One embodiment of a foot bar according the present disclosure includes an inverted U shape carbon fiber tube having ends each fixed to a foot bar support member. Each foot bar support member has a cylindrical base, a cylindrical post welded to the base, and a foot bar support arm welded to one end of the cylindrical base.

A reformer in accordance with the present disclosure may be viewed as a generally rectangular frame having a pair of parallel spaced side rail portions, a head end portion, and a foot end portion. The reformer includes a movable carriage supported by the side rail portions for movement of the carriage between the head and foot end portions, and a bias member connected between the carriage and the foot end portion of the frame for biasing the carriage toward the foot end of the frame.

The reformer has a foot support member supported by the side rail portions of the frame, wherein the foot support member has an inverted U shape carbon fiber tube having ends each fixed to a foot bar support member having a cylindrical base, a cylindrical post welded to the base, and a foot bar support arm welded to one end of the cylindrical base.

A reformer exercise apparatus in accordance with the present disclosure includes a generally rectangular frame having a pair of parallel spaced side rail portions, a head end portion, and a foot end portion, a movable carriage supported by the side rail portions for movement of the carriage between the head and foot end portions, a bias member connected between the carriage and the foot end portion of the frame for biasing the carriage toward the foot end of the frame, and a foot support member supported by the side rail portions of the frame. The foot support member has an inverted U shape carbon fiber tube having ends each fixed to a foot bar support member. This foot bar support member has a cylindrical base, a cylindrical post welded to the base, and a foot bar support arm welded to one end of the cylindrical base. Each end of the carbon fiber tube is telescopically received over one of the cylindrical posts of one of the foot bar support members and adhesively bonded thereto. Each cylindrical post includes a plurality of spaced annular grooves around the post. Each cylindrical post is preferably tubular. The foot bar support member preferably includes a tubular cushion over the carbon fiber tube and a zippered fabric cover over the tubular cushion over the carbon fiber tube.

An embodiment in accordance with the present disclosure may alternatively be viewed as a foot support member for use in a reformer exercise apparatus that includes a generally rectangular frame having a pair of parallel spaced side rail portions, a head end portion, and a foot end portion, and a movable carriage supported by the side rail portions for movement of the carriage between the head and foot end portions. The foot support member has a pair of foot bar support members movably attached to the side rail portions of the frame and an inverted U shape carbon fiber tube having opposite ends each telescopically received over and fixed to a cylindrical post of one of the pair of foot bar support members welded to a base of the foot bar support member. The carbon fiber tube has a foot support portion extending at a right angle to and between a pair of parallel leg portions extending between the foot support portion and the ends.

An embodiment according to the present disclosure may alternatively be viewed a reformer exercise apparatus including a generally rectangular frame having a pair of parallel spaced side rail portions, a head end portion, and a foot end portion, a movable carriage supported by the side rail portions for movement of the carriage between the head and foot end portions, a bias member connected between the carriage and the foot end portion of the frame for biasing the carriage toward the foot end of the frame. A foot support member is supported by the side rail portions of the frame. The foot support member has a pair of foot bar support members movably attached to the side rail portions of the frame and an inverted U shape carbon fiber tube having opposite ends each telescopically received over and fixed to a cylindrical post of one of the pair of foot bar support members welded to a base of the foot bar support member. The U shaped carbon fiber tube has a foot support portion extending at a right angle to and between a pair of parallel leg portions extending between the foot support portion and the ends. The foot support member preferably includes a tubular cushion over the carbon fiber tube and a zippered fabric cover over the tubular cushion over the carbon fiber tube.

DETAILED DESCRIPTION

Figure 1:
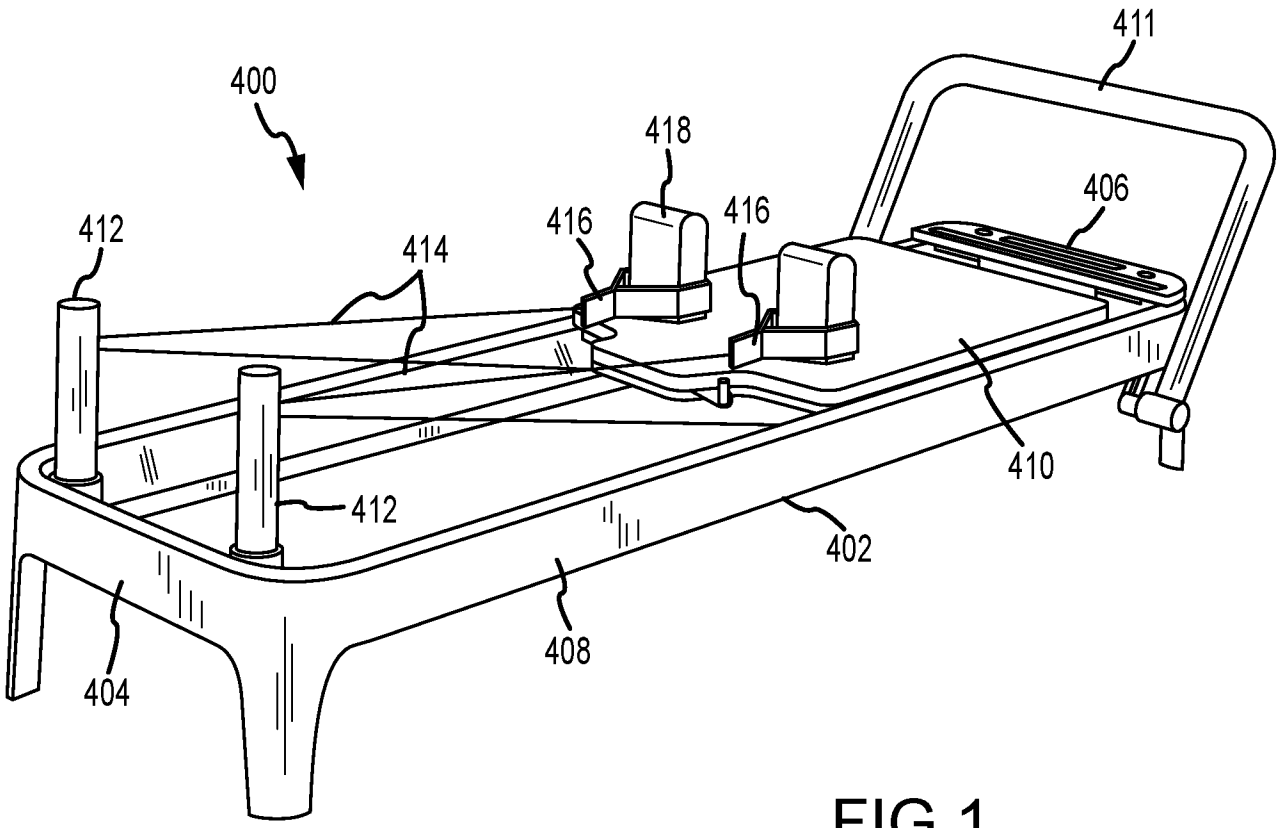
FIG.1 PRIOR ART
FIG. 1 is a perspective view of a conventional reformer exercise apparatus.
Figure 2:
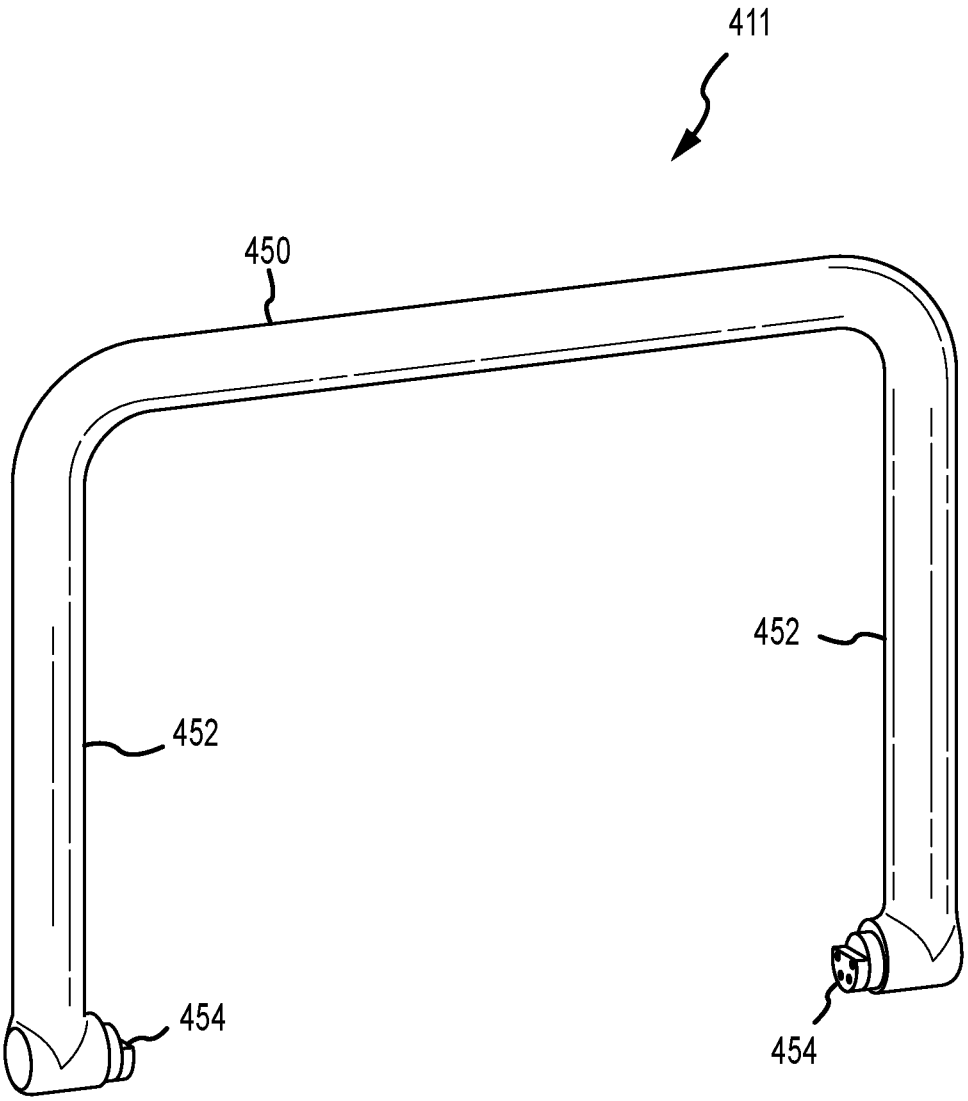
FIG.2 PRIOR ART
FIG. 2 is a separate perspective view of the foot bar in the conventional reformer exercise apparatus shown in FIG. 1.
Figure 3:
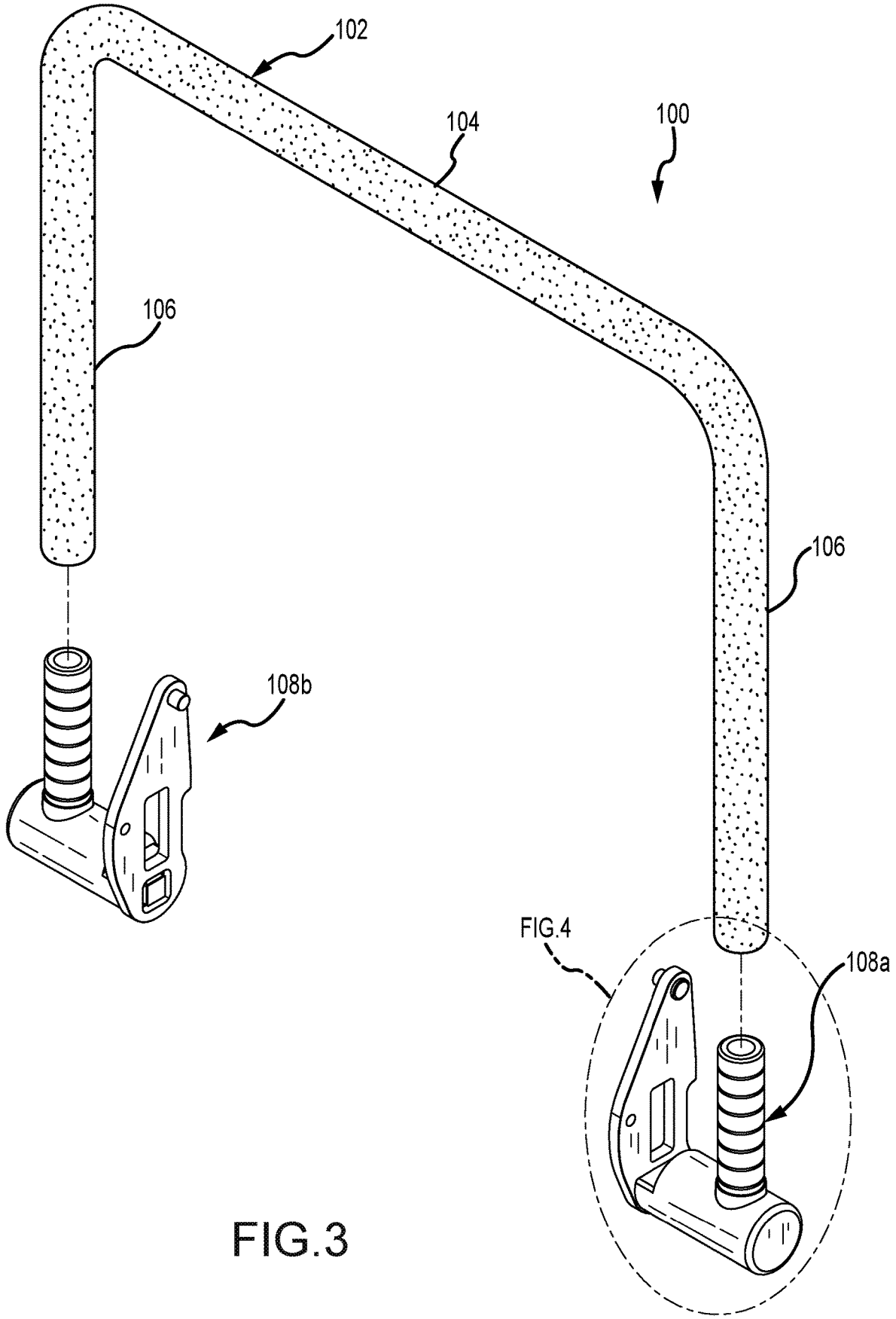
FIG. 3 is an exploded perspective view of a lightweight foot bar for a reformer in accordance with the present disclosure prior to installation of a cushion sleeve and vinyl fabric cover.
Figure 4:
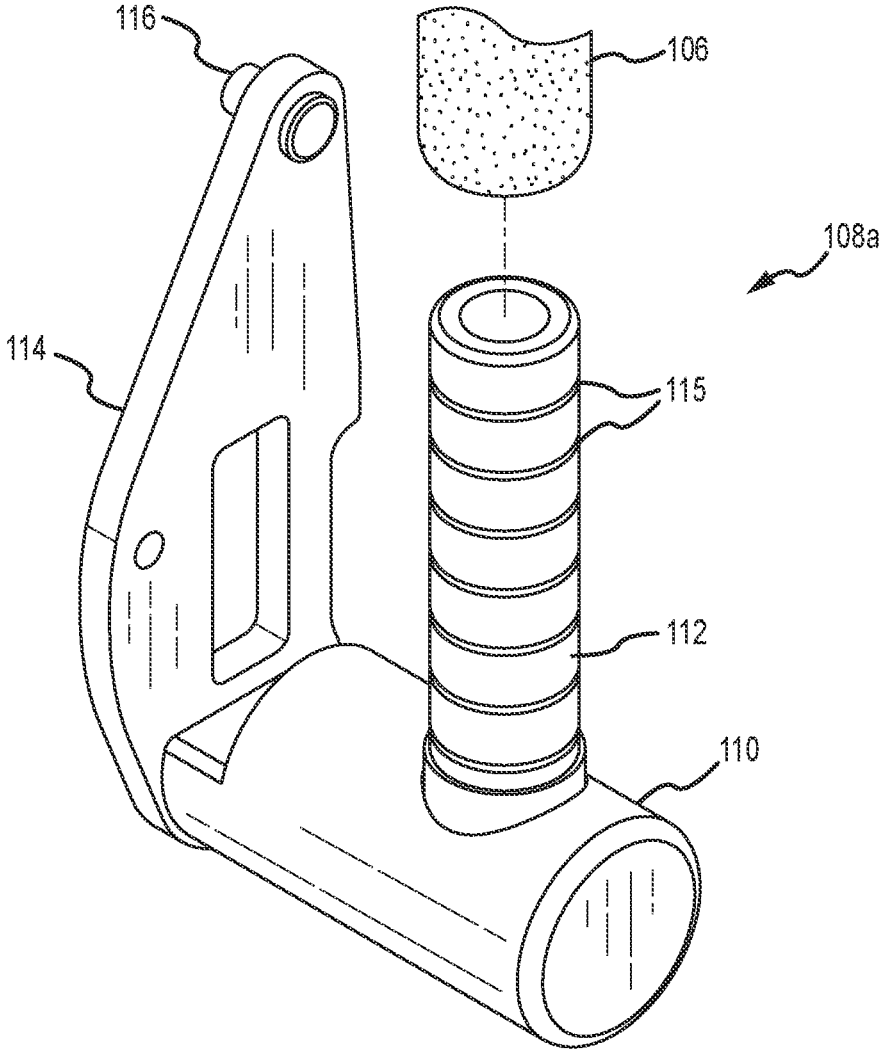
FIG. 4 is a separate exploded perspective view of a bottom end of the foot bar shown in FIG. 3.

An exploded perspective view of one exemplary embodiment of a lightweight foot bar 100 in accordance with the present disclosure is shown in FIG. 3. The foot bar 100 includes an inverted U shaped carbon fiber tube 102 which has a straight horizontal foot support portion 104 and two parallel leg portions 106 each bent at a right angle to the horizontal foot support portion 104 and a pair of foot bar support members 108*a* and 108*b* bonded permanently to the distal ends of the leg portions 106.

Each foot bar support member 108*a* and 108*b* is a single unitary steel body which has a short cylindrical base 110 having a cylindrical outer side and opposite ends, a tubular spud or post 112 welded into a radial bore in the cylindrical side of the cylindrical base 110 so as to extend radially from the base 110, and an elongated flat plate foot bar support arm 114 having one end welded at a right angle to one end of the cylindrical base 110 so that the support arm 114 extends parallel to the post 112. The other end of the elongated flat plate foot bar support arm 114 has an engaging pin 116 projecting out from the foot bar support arm 114 at a right angle to the arm 114 away from the post 112 for engaging a feature in a hook plate (not shown) in the foot support assembly described in detail in each of the patents mentioned above. The support arm 114 on member 108*a* is oriented in one direction on the base 110. The support arm 114 on member 108*b* is reversed as is shown in FIG. 3.

The carbon fiber foot bar tube 102 has an inner diameter of about 1.07 inch and an outer diameter of about 1.25 inch, thus having a wall thickness of about 0.125 inch. The spud post 112 in this exemplary embodiment projects from the cylindrical base 110 about 3.6 inches and includes a series of axially spaced annular grooves 115 in its outer surface to facilitate distribution of epoxy adhesive. The post 112 may be a solid cylindrical body or may be tubular as shown and has an outer diameter preferably about 1.04 inch.

The distal end of the leg portion 106 of carbon fiber foot bar tube 102 is sized to telescopically fit over the post 112 of one of foot bar support members 108*a* and 108*b* and is secured thereto via an epoxy adhesive. Similarly, the distal end of the other leg portion 106 of the foot bar tube 102 is telescopically slipped over the other post 112 of the other foot bar support member 108*a* or 108*b* and bonded thereto with the epoxy adhesive.

Figure 5:
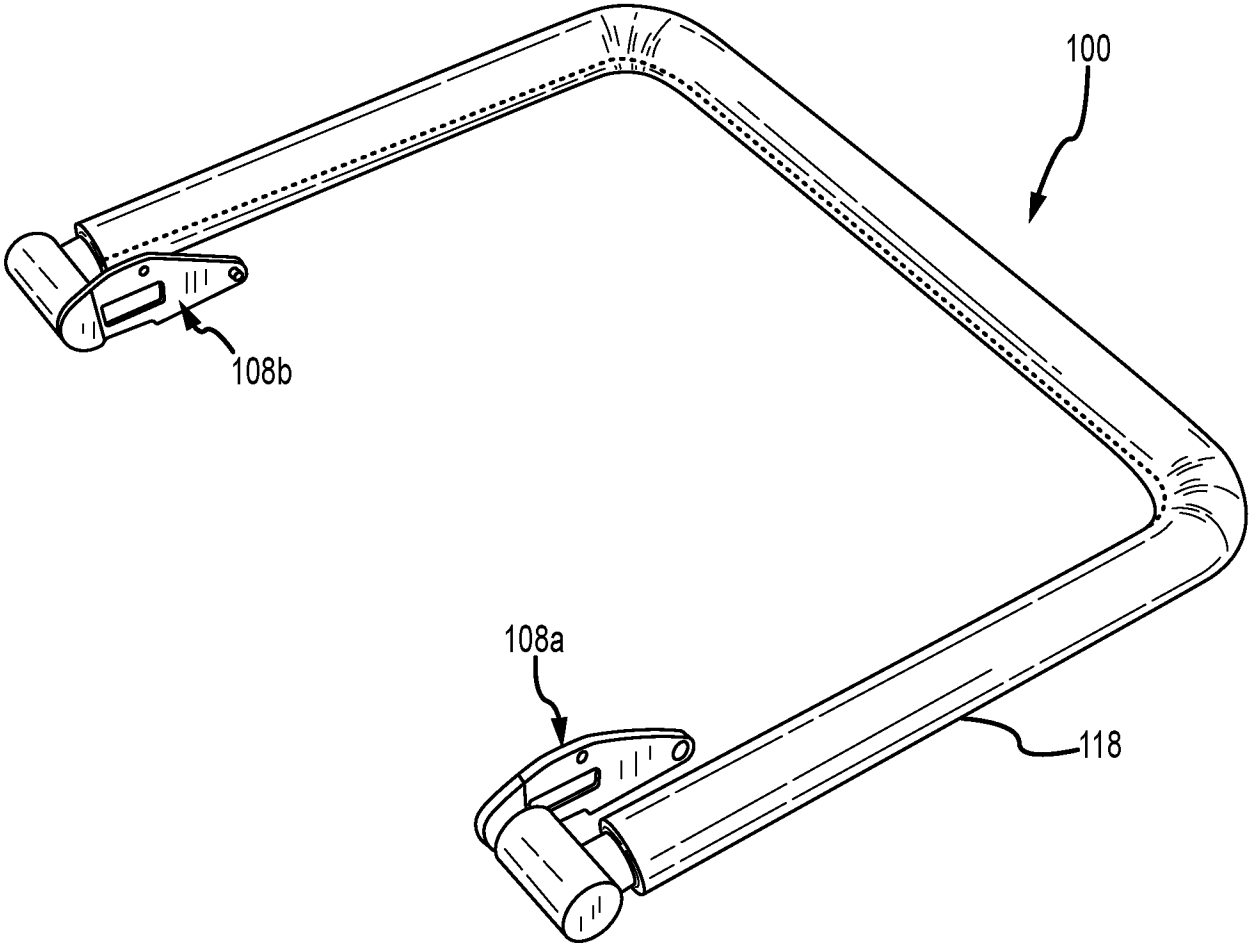
FIG. 5 is a perspective view of the lightweight foot bar shown in FIG. 3 with its cushion sleeve and zippered cover installed.

Prior to joinder of the tube 102 to the foot bar support members 108*a* and 108*b*, a closed cell polymeric foam sleeve is slipped over the foot bar tube 102 which provides about a ⅜ inch thick cushion around the tube 102. Finally, after bonding the foot bar support members to the foot bar tube 102, a vinyl fabric zippered cover 118 is preferably wrapped around the sleeve covered foot bar tube 102 and zipped closed to complete the assembly of the foot bar 100 as is shown in FIG. 5.

Many changes may be made to the foot bar of this disclosure. For example, the cushion sleeve may be dimensioned other than as above described and the vinyl fabric cover may be different than that shown in FIG. 5. The dimensions of the foot bar tube 102 may differ as well. Accordingly, all such alternatives, variations and modifications are intended to be encompassed within the scope of and as defined by the following claims.

What is claimed is:

1. A reformer exercise apparatus comprising:

a generally rectangular frame having a pair of parallel spaced side rail portions, a head end portion, and a foot end portion;

a movable carriage supported by the side rail portions for movement of the carriage between the head and foot end portions;

a bias member connected between the carriage and the foot end portion of the frame for biasing the carriage toward the foot end of the frame; and a foot support member supported by the side rail portions of the frame, wherein the foot support member has an inverted U shape carbon fiber tube having ends each fixed to a foot bar support member having a cylindrical base, a cylindrical post welded to the base, and a foot bar support arm welded to one end of the cylindrical base.

2. The reformer exercise apparatus according to claim 1 wherein each end of the carbon fiber tube is telescopically received over one of the cylindrical posts of one of the foot bar support members and adhesively bonded thereto.

3. The reformer exercise apparatus according to claim 2 wherein each cylindrical post includes a plurality of spaced annular grooves around the post.

4. The reformer exercise apparatus according to claim 2 wherein each cylindrical post is tubular.

5. The reformer exercise apparatus according to claim 1 further comprising a tubular cushion over the carbon fiber tube.

6. The reformer exercise apparatus according to claim 5 further comprising a zippered fabric cover over the tubular cushion over the carbon fiber tube.

7. The reformer exercise apparatus according to claim 6 wherein the zippered fabric cover is a vinyl fabric.

8. A foot support member for use in a reformer exercise apparatus having a generally rectangular frame having a pair of parallel spaced side rail portions, a head end portion, and a foot end portion, a movable carriage supported by the side rail portions for movement of the carriage between the head and foot end portions, a bias member connected between the carriage and the foot end portion of the frame for biasing the carriage toward the foot end of the frame, wherein the foot support member is supported by the side rail portions of the frame, the foot support member comprising:

a pair of foot bar support members attached to the side rail portions of the frame, each foot bar support member having a base, a foot bar support arm fastened to the base and a cylindrical post welded to the base; and an inverted U shape carbon fiber tube having opposite ends each telescopically received over and fixed to the cylindrical post of each of the pair of foot bar support members.

9. The foot support member according to claim 8 wherein each cylindrical post includes a plurality of spaced annular grooves around the post.

10. The foot support member according to claim 9 wherein the U shaped carbon fiber tube has a foot support portion extending at a right angle to and between a pair of parallel leg portions extending between the foot support portion and the ends.

11. The foot support member according to claim 8 wherein each cylindrical post is tubular.

12. The foot support member according to claim 8 wherein the support arm extends parallel to the cylindrical post.

13. The foot support member according to claim 8 further comprising a tubular cushion over the carbon fiber tube.

14. The foot support member according to claim 13 further comprising a zippered fabric cover over the tubular cushion over the carbon fiber tube.

15. The foot support member according to claim 14 wherein the zippered fabric cover is a vinyl fabric.

16. A reformer exercise apparatus comprising:

a generally rectangular frame having a pair of parallel spaced side rail portions, a head end portion, and a foot end portion;

a movable carriage supported by the side rail portions for movement of the carriage between the head and foot end portions; and a foot support member supported by the side rail portions of the frame, wherein the foot support member has a pair of foot bar support members movably attached to the side rail portions of the frame and an inverted U shape carbon fiber tube having opposite ends each telescopically received over and fixed to a cylindrical post of each of the pair of foot bar support members welded to a base of the respective foot bar support member, and a foot bar support arm fastened to one end of the base of the respective foot bar support member.

17. The reformer exercise apparatus according to claim 16 wherein each cylindrical post is tubular.

18. The reformer exercise apparatus according to claim 16 further comprising a tubular cushion over the carbon fiber tube.

19. The reformer exercise apparatus according to claim 18 further comprising a zippered fabric cover over the tubular cushion over the carbon fiber tube.

20. The reformer exercise apparatus according to claim 19 wherein the zippered fabric cover is a vinyl fabric.

* * * * *